US005118911A

United States Patent [19]

Yorita

[11] Patent Number: 5,118,911

[45] Date of Patent: Jun. 2, 1992

[54] HIGH VOLTAGE VACUUM INSULATING CONTAINER

[75] Inventor: Mitsumasa Yorita, Amagasaki, Japan

[73] Assignee: Mitsubishi Denki Kabushiki Kaisha, Tokyo, Japan

[21] Appl. No.: 559,049

[22] Filed: Jul. 30, 1990

[30] Foreign Application Priority Data

Aug. 1, 1989 [JP] Japan ..... 1-200503

[51] Int. Cl.[5] ..... H01H 33/66

[52] U.S. Cl. ..... 200/144 B

[58] Field of Search ..... 200/144 R-151, 200/144 B; 174/30, 209, 212, DIG. 8

[56] References Cited

U.S. PATENT DOCUMENTS

| | | | |
|---|---|---|---|
| 3,590,184 | 6/1971 | Wachta et al. | 200/144 B |
| 4,393,286 | 7/1983 | Takagi | 200/144 B |
| 4,433,203 | 2/1984 | Takagi | 174/30 |
| 4,896,008 | 1/1990 | Aoki et al. | 200/144 B |

FOREIGN PATENT DOCUMENTS

| | | |
|---|---|---|
| 0309978 | 5/1989 | European Pat. Off. . |
| 3411724 | 10/1985 | Fed. Rep. of Germany . |
| 57-36735 | 2/1982 | Japan . |
| 63-12336 | 3/1988 | Japan . |

*Primary Examiner*—J. R. Scott

*Attorney, Agent, or Firm*—Oblon, Spivak, McClelland, Maier & Neustadt

[57] ABSTRACT

A high voltage vacuum insulating container includes a cylindrical insulating tube and sealing metal members sealingly fitted to both ends of the cylindrical insulating tube which receives therein a pair of opposing electrodes to be applied with a high voltage, wherein a metal ring is provided at each end of the cylindrical insulating tube so as to surround the each end in an annular form wherein the metal ring has a plurality of portions bulged out with a radius of curvature toward the insulating tube wherein the top of each of the bulged out portions is in contact with an imaginary line extending at an angle of 45°-30° to the outer surface of the insulating tube.

4 Claims, 2 Drawing Sheets

FIGURE 1
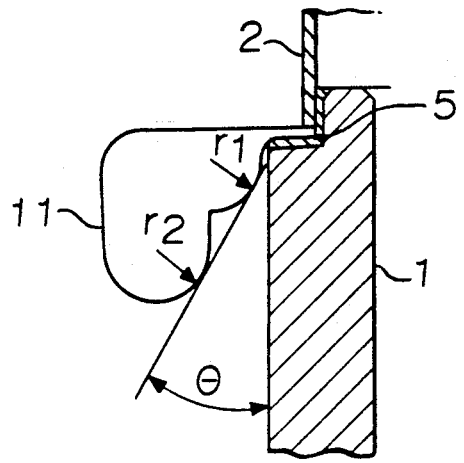
FIGURE 2
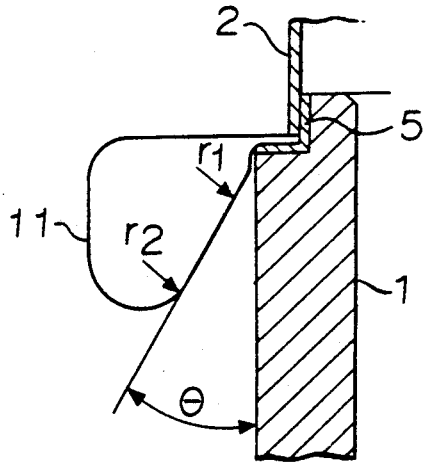
FIGURE 3
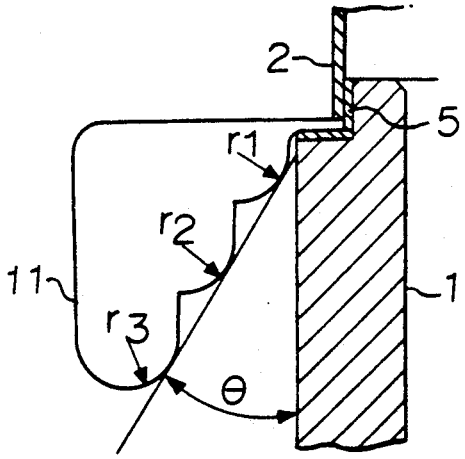
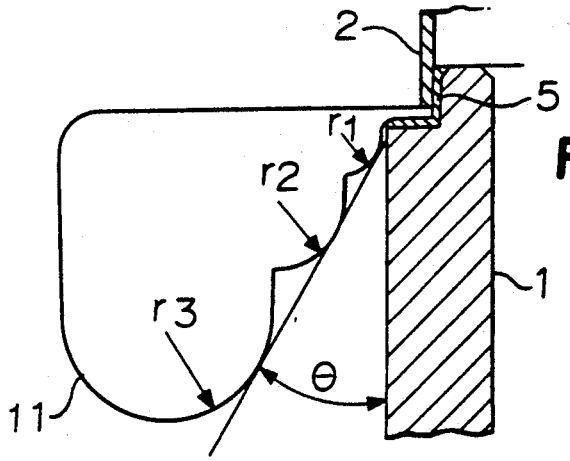
FIGURE 4

HIGH VOLTAGE VACUUM INSULATING CONTAINER

BACKGROUND OF THE INVENTION

1. Field of the Invention

The present invention relates to a high voltage vacuum insulating container used for a vacuum switch tube an electron tube or the like.

2. Discussion of the Background

FIG. 6 is a cross-sectional view of an X-ray tube disclosed in, for instance, Japanese Unexamined Patent Publication No 36735/1982, and FIG. 7 is an enlarged view showing a part A in FIG. 6. In FIGS. 6 and 7, a reference numeral 1 designates an insulating tube, a numeral 2 designates a sealing metal member, numerals 3 and 4 designate electrodes and numerals 3A and 4A designate terminals for the electrodes. A metal ring 11 is attached to both ends of the insulating tube so as to be close to the outer circumference of the insulating tube 1, and the sealing metal member has its free end curved with a large radius of curvature. The insulating tube 1, the sealing metal member 2 and the metal ring 11 constitute a high voltage vacuum insulating container 20.

The function of the above-mentioned high voltage vacuum insulating container will be described. Generally, the high voltage vacuum insulating container 20 used for a device such as an electron tube, a vacuum switch tube or the like maintains the electrodes 3, 4 in a vacuum condition and isolates electrically the one of the electrodes 3, 4 from the other. As a material for the insulating tube 1 which constitutes the main body of the high voltage vacuum insulating container 20, glass or ceramics is usually used. In particular, ceramics having an excellent strength is widely used. When such ceramic material is used for the insulating tube 1, it is necessary to sealingly attach the sealing metal members 2 to the insulating tube 1. The attaching of the sealing metal members 2 has been conducted by forming a metallized layer 5 such as molybdenum, manganese or the like at the ceramic side and the sealing metal members 2 are attached to the metallized layers 5 by soldering.

The conventional high voltage vacuum insulating container 20 having the above-mentioned construction had a problem that when a high voltage is applied to the container, an electric field is concentrated to a metallized layer on the ceramic tube or a soldered portion to thereby produce an electric discharge along the outer surface of the ceramic tube. In order to solve such problem, the metal ring 11 was proposed. The metal ring 11 is to moderate the concentration of an electric field near the metallized layer 5, the soldered portion or a joint portion therebetween because the metal ring 11 having a bent portion bent with a large radius of curvature is arranged in an annular form in the vicinity of the outer circumference of the both ends of the ceramic insulating tube. Thus, an electric discharge caused along the outer circumference of the ceramic tube was suppressed.

However, in the high voltage vacuum insulating container as constructed above, when a further high voltage was applied across the electrodes, there was found a creeping discharge from the metal ring 11 to the insulating tube as indicated by a reference numeral 6 in FIG. 8. The creeping discharge results because the metal ring 11 is disposed in the vicinity of the insulating tube 1 and the intensity of an electric field increases at the place including the metal ring 11 and the surface of the insulating tube 1 which are adjacent to each other. In order to increase a creeping discharge voltage, the metal ring 11 has to have a large radius of curvature, which results in the manufacture of a high voltage vacuum insulating container with a metal ring 11 having a large outer diameter. This is contrary to a demand of miniaturization of a container for an electron tube, a vacuum switch tube or the like.

SUMMARY OF THE INVENTION

It is an object of the present invention to provide a small-sized high voltage vacuum insulating container which is usable under a high voltage.

In accordance with the present invention, there is provided a high voltage vacuum insulating container comprising a cylindrical insulating tube and sealing metal members sealingly fitted to both ends of the cylindrical insulating tube which receives therein a pair of opposing electrodes to be applied with a high voltage, characterized in that a metal ring is provided at each end of the cylindrical insulating tube so as to surround each end in an annular form wherein the metal ring has a plurality of portions bulged out with a radius of curvature toward the insulating tube wherein the top of each of the bulged-out portions is in contact with or near an imaginary line extending at an angle of 45°-30° to the outer surface of the insulating tube.

BRIEF DESCRIPTION OF THE DRAWINGS

FIG. 1 is a longitudinal cross-sectional view of an important portion of the high voltage vacuum insulating container according to an embodiment of the present invention;

FIGS. 2 through 5 are respectively longitudinal cross-sectional views similar to FIG. 1 which show other embodiments of the present invention;

DESCRIPTION OF THE PREFERRED EMBODIMENTS

Figure 5:
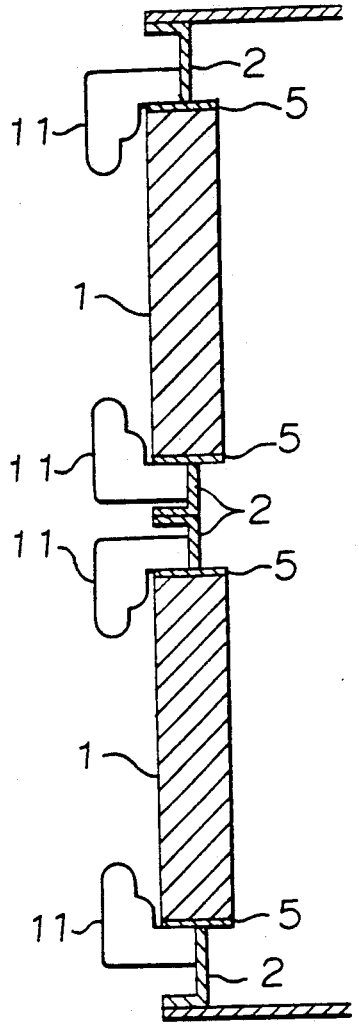
Figure 7:
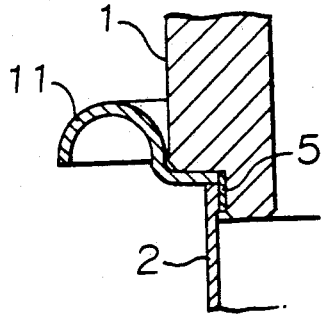
FIGURE 7 PRIOR ART
FIG. 7 is a longitudinal cross-sectional view showing a part A in FIG. 6.
Figure 8:
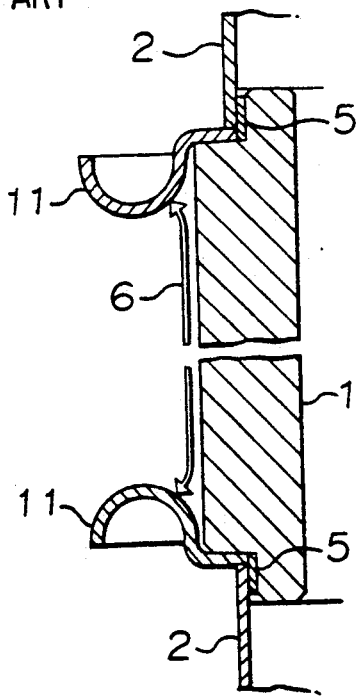
FIGURE 8 PRIOR ART
FIG. 8 is a diagram showing a creeping discharge in a conventional high voltage vacuum insulating container.
Figure 6:
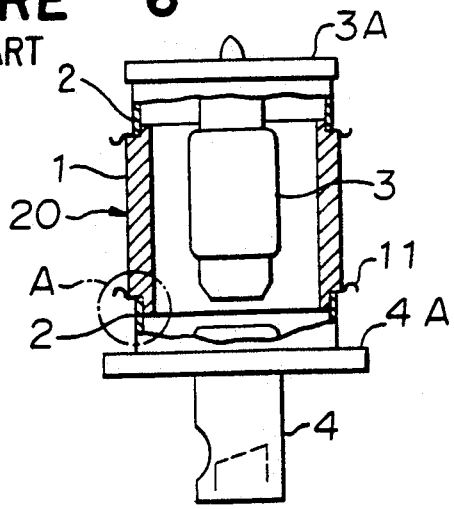
FIGURE 6 PRIOR ART
FIG. 6 is a front view partly cross-sectioned of a conventional high voltage vacuum insulating container.

A preferred embodiment of the high voltage vacuum insulating container according to the present invention will be described with reference to the drawings.

In FIG. 1, a reference numeral 1 designates an insulating tube, a numeral 2 designates a sealing metal member, and a numeral 11 designates a metal ring which has two portions bulged-out toward the insulating tube 1. The first and second bulged-out portions respectively have radii of curvature r1 and r2. The metal ring with the bulged-out portions is arranged in an annular form in the vicinity of the outer circumference of the insulating tube 1. The top of first bulged-out portion formed with a radius of curvature r1 and the second bulged-out portion formed with a radius of curvature r2 are respectively in contact with or near an imaginary line extending at an angle of $\theta$ to the surface of the insulating tube 1, the imaginary line starting from a point at or near each end of the insulating tube and near the first bulged-out portion with radius of curvature r1. The angle $\theta$ is preferably in a range of 45°-30°. The first bulged-out portion with radius of curvature r1 is arranged near one of opposing electrodes.

The function of the above-mentioned embodiment will be described. In FIG. 1, the first bulged-out portion with a radius of curvature r1 of the metal ring 11 is arranged in the same manner as the conventional container described before, and the intensity of an electric field at the metallized layer and the soldered portion at the joined portion between the insulating tube 1 and the sealing metal member 2 can be reduced. The second bulged-out portion with a radius of curvature r2 is formed so as to be contiguous to the first bulged-out portion so that the top of the second bulged-out portion is in contact with or near the imaginary line extending to the surface of the insulating tube 1 at an angle of $\theta$. Accordingly, the first bulged-out portion and the surface of the insulating tube 1 near the first bulged-out portion is behind the second bulged-out portion, whereby the intensity of the electric field is reduced.

The optimum angle $\theta$ in the arrangements of the first and second bulged-out portions to the surface of the insulating tube 1 is in a range of 45°-30°. When the angle $\theta$ is smaller than that range, the intensity of an electric field at the second bulged-out portion and the surface of the insulating tube 1 near the second bulged-out portion becomes strong and a creeping discharge may result. On the other hand, when the angle $\theta$ is greater than that range, the intensity of the electric field becomes small to thereby provide little effect.

If the same effect of greatly reducing any creeping discharge is expected with use of a metal ring 11 having a single bulged-out portion, it is necessary to use the metal ring having a bulged-out portion with a large radius of curvature. This was confirmed through experiments.

In the above-mentioned embodiment, two bulged-out portions are stepwisely formed in the metal ring 11. However, a metal ring with a single bulged-out portion wherein the top of each of the bulged-out portions as in FIG. 1 are connected by a linear line, may be used as shown in FIG. 2.

Three or more bulged-out portions may be formed in the metal ring as shown in FIG. 3 rather than two bulged-out portions as in FIG. 1.

In the embodiment as shown in FIG. 1, the two bulged-out portions have the same radius of curvature. However, they may have different sizes of radius of curvature. In this case a, more excellent effect can be obtained by constructing the metal ring in such a manner that the radius of curvature of the bulged-out portion remote from the insulating tube is larger than that of the bulged-out portion which is near the insulating tube.

When a plurality of insulating tube are used to constitute an electron tube or a vacuum switch tube, the metal ring 11 may be provided at each of the sealing metal members 2 as shown in FIG. 5.

The same effect is obtainable even by using an insulating tube made of glass instead of the ceramic insulating tube. Thus, in accordance with the present invention, a high voltage vacuum insulating container having a small outer diameter which allows the application of a high voltage, can be provided.

What is claimed is:

1. A high voltage vacuum insulating container comprising:

a cylindrical insulating tube; and sealing metal members sealingly fitted to both ends of the cylindrical insulating tube;

said cylindrical insulating tube receiving therein a pair of opposing electrodes to be applied with a high voltage, characterized in that a metal ring is provided at each end of the cylindrical insulating tube in contact with a corresponding sealing metal member so as to surround the each end in an annular form;

wherein said metal ring has a plurality of portions bulged-out with a radius of curvature toward the insulating tube; and wherein the top of each of the bulged-out portions is in contact with or near an imaginary line extending at an angle of 45°-30° from the outer surface of the insulating tube.

2. The high voltage vacuum insulating container according to claim 1, wherein said bulged-out portions have different radii of curvature.

3. The high voltage vacuum insulating container according to claim 1, wherein said imaginary line extends from each end of said insulating tube and near the bulged-out portion which is formed at the nearest portion to the insulating tube.

4. The high voltage vacuum insulating container according to claim 2, wherein the radius of curvature of the bulged-out portions remote from the insulating tube is larger than that of the bulged-out portion which is near the insulating tube.

* * * * *